US005660891A

United States Patent [19]

Kenyon et al.

[11] Patent Number: 5,660,891

[45] Date of Patent: Aug. 26, 1997

[54] METHOD AND SYSTEM FOR CLEANING AND SLIP-RESISTANT TREATMENT OF SURFACE COVERINGS

[75] Inventors: Bradford H. Kenyon; Eugene W. Montrose; William D. Barnes, all of Portland, Oreg.

[73] Assignee: Medical Security Corporation, Portland, Oreg.

[21] Appl. No.: 587,286

[22] Filed: Jan. 16, 1996

Related U.S. Application Data

[63] Continuation of Ser. No. 315,818, Sep. 30, 1994, abandoned.

[51] Int. Cl.[6] ..... B05D 3/00

[52] U.S. Cl. ..... 427/445; 134/2; 134/3; 510/214; 510/240

[58] Field of Search ..... 134/2, 3; 427/445; 252/106, 107, 142

[56] References Cited

U.S. PATENT DOCUMENTS

| | | | |
|---|---|---|---|
| 3,650,965 | 3/1972 | Cantor et al. | 252/106 |
| 3,879,237 | 4/1975 | Faigen et al. | 148/252 |
| 4,472,205 | 9/1984 | Cortner | 134/27 |
| 4,479,543 | 10/1984 | Kalfayan et al. | 166/307 X |

*Primary Examiner*—Michael Lusignan

*Attorney, Agent, or Firm*—Marger Johnson McCollom & Stolowitz, P.C.

[57] ABSTRACT

A method for cleaning and slip-resistant treatment of a mineral floor surface including an untreated outer surface having an initial dynamic coefficient of friction is provided, The untreated outer surface has a residual film formed thereon which further includes bacterial contamination. The method comprises first forming a treatment solution comprising ammonium bifluoride, iodine, phosphoric acid, and water. Then, the treatment solution is applied to the untreated outer surface of the mineral floor surface wherein (a) the amount of residual film formed thereon is substantially reduced (b) the initial dynamic coefficient of friction is increased by at least about 10%, and (c) bacterial contamination on said untreated outer surface is substantially eliminated for at least about 24 hours.

20 Claims, No Drawings

METHOD AND SYSTEM FOR CLEANING AND SLIP-RESISTANT TREATMENT OF SURFACE COVERINGS

RELATED APPLICATION

This is a continuation of application Ser. No. 08/315,818, filed Sep. 30, 1994, now abandoned.

BACKGROUND OF THE INVENTION

The present invention relates generally to a system and method for cleaning and slip-resistant treatment of surface coverings, particularly hard mineral surface coverings particularly those which are silicon-containing. Examples of these surface coverings are floor coverings such as tile and cement or concrete. These floors are durable and can be readily cleaned. A particular problem are commercial floor surfaces which are monitored by government public health agencies. In this instance, these commercial floor coverings must be cleaned on a daily basis with a chemical cleaning agent such as bleaching agents, degreasing detergents, powder cleaners and steam cleaners.

Another aspect of this cleaning problem is the slippery nature of these types of floor coverings. These floors should be made to be slip-resistant in order to avoid accidents. Therefore standards have been established for these floor coverings wherein a minimum dynamic coefficient of friction, measured according to ASTM Test No. C1028-89, was established of at least 0.6. However the use of conventional cleaning agents reduces the coefficient of friction to an unsafe level. This problem is caused by residual amounts of cleaner which coat the surface of the floor covering forming an unwanted layer thereon. Furthermore, moisture is trapped beneath the layers of cleaner residue which breeds germs and contaminants.

Several prior art U.S. patents address the above-described problems. For example, in U.S. Pat. No. 2,492,975 to Elliott, a method and means are described for conditioning a floor and increasing its coefficient of friction for use in ballroom dancing or for gymnasium activities. The formulation to increase the frictional coefficient of a floor coating includes 75 parts by volume mineral spirits, 20 parts by volume raw linseed oil, 2 parts by volume petroleum jelly, 2 parts by volume light petroleum lubricating oil, and 1 part by volume cotton seed oil.

In U.S. Pat. Nos. 4,749,508 and 4,877,459 to Cockrell, et al, acidic floor cleaning compositions are employed to improve the coefficient of static friction of floors, especially quarry tile, in environments conducive to the buildup of slippery-when-wet films. These compositions comprise (a) a first acidic component such as citric, isocitric, tartaric, maleic mono-hydroxyacetic, acetic or gluconic acid, (b) a second acidic component selected from sulfamic acid, phosphoric acid, maleic acid, sodium bisulfate, sodium bisulfite, an organic sulfonic acid, an organic phophonic acid, an organic ester of sulfuric acid, and an organic ester of phosphoric acid, (c) a buffering salt of a weak acid such as sodium acid pyrophosphate, monosodium phosphate, sodium acetate, and sodium citrate, (d) sodium alkylnaphthalene sulfonate and sodium xylene sulfonate, and a surfactant. The above composition is essentially free of hydrofluoric and glutaric acid.

U.S. Pat. No. 4,990,188 to Micek et al. is directed to an anti-slip composition. The composition comprises a major amount of sodium bicarbonate and a minor amount of a coefficient friction improving agent which is a substantially water insoluble inorganic abrasive.

U.S. Pat. No. 5,110,657 to Ainslie describes an anti-skid coating composition. This coating consists essentially of a binder composition and an aggregate such as walnut shells.

U.S. Pat. No. 5,223,168 to Holt is an acid-based cleaner for cleaning and treating tile, limestone-based cement and concrete and similar surfaces to maintain a slip-resistant surface, and to harden and strengthen the grout or cement and make it more resistant to penetration by salt and other deleterious chemicals. The cleaner comprises an aqueous solution of hydrofluoric acid, phosphoric acid, and a surface active or wetting agent. However, HF is toxic and an extreme hazard to the user.

SUMMARY OF THE INVENTION

The system and method of this invention for surface cleaning and slip-resistant treatment of floors of the present invention overcomes the prior art problems of cleaner build-up, slip-resistance, gross germ contamination and applicators safety when treating or maintaining mineral surface floors. The subject system and method relates to the care of mineral surface floors and comprises both the enhancement of the slip-resistant properties of mineral floor surfaces, particularly silicon-containing mineral surface floors, as well as the cleaning of these floors which contemplates the disinfecting and sanitizing of bacteria, mold and fungi build-up which exists on the floors.

More specifically, a method for cleaning and slip-resistant treatment of a mineral floor surface, such as tiles or cement, is provided. After applying the treatment solution to the untreated outer surface of the mineral floor surface, the amount of residual film formed thereon is substantially reduced. Further, the same solution reacts with exposed grout or cement between tiles to form a hardened sheen which significantly extends the useful life of the grout. This invention serves to extend the useful life of mineral surface floors whereas prior art high-strength cleaners corrode and lessens the useful life of same.

This invention is preferably designed to increase the slip resistant characteristics of surfaces containing the element silicon by chemically changing some of the silicon dioxide bonds, normally found in such surfaces, to a silicon halide (iodine and fluorine) complex that has a much higher coefficient-of-friction (C of F) than does silicon dioxide, wet or dry conditions prevailing. The composition effectively disassociates oxygen from its bond with silicon in silicon containing surfaces and replaces the oxygen with the halogen fluorine, yielding an end-product of a silicon-fluoride complex. This silicon fluoride complex contributes a measurably higher coefficient of friction (wet or dry conditions prevailing) than does the original silicon dioxide. Silicon-fluoride contributes a measurably higher coefficient of friction (dynamic or static) wet or dry conditions prevailing, than does silicon-dioxide. Additionally, this invention's contribution of silicon halide iodine to tests of subject surfaces indicate that such silicon halides of iodine enhance the subject surfaces ability to deter colonization of pathogenic micro organisms. Food contact surfaces, including counters, floors, etc., may present with beverage and/or food residues (fats, greases, oils, etc.) with organic properties and micro organisms that may contribute to a slippery surface condition. The subject chemical composition will effectively remove these surface contaminants. In a preferred form of this invention, the subject chemical agent will effectively chemically combine with the, above contaminants in a saponification process to produce a soap that will effectively remove these surface contaminants.

On those surfaces contaminated with organic material such as vegetable or animal fats, greases, juices, blood, etc., the invention is thought to perform as follows:

a. The treatment solution preferably reacts to form a biodegradable, odorless, germicidal soap that in itself will clean subject surfaces, have a substantially higher flash point than the organic contaminants themselves, and leave a residue completely safe to handle or to dispose of down a drain.

b. The chemical process of soap making accelerates the process of changing the silicon dioxide in the surface material to a silicon halide (iodine and fluorine) complex that substantially increases the slip-resistant characteristics of the treated surface, wet or dry conditions prevailing.

c. The invention's composition performs a broad spectrum germicidal function when applied to all currently known bacteria, fungi, mildews, molds and viruses including Tuberculin and HIV.

d. This invention's composition together with its generated soap and byproducts is safe to handle and is neither corrosive nor hazardous. The pH of these combined products and their residue is between 4.0 and 4.5, about the same as a person's tears.

On silicon containing surfaces contaminated by other than the organic contaminants listed above, the invention performs as follows:

a. The ammonia and the iodophor work to loosen any surface contaminants. Agitation by brushing. accelerates this process and allows the contaminants to be rinsed more quickly from the surface so the chemical reaction of this invention can take place between this invention and the silicon containing surface.

b. The fluoride and the iodophor quickly destroy all subject surface contaminants, e.g. bacteria, fungi, molds, mildew and viruses, leaving a completely germ-free surface.

c. The silicon dioxide in the surface to be treated becomes a silicon halide (fluorine and iodine) complex and the tested slip resistant characteristics of the treated surface are materially enhanced, wet or dry conditions prevailing.

d. The treated germ free surface has a substantial residual germicidal effect even after repeated rinsing with water.

e. Surfaces treated with this invention are safe to use even when they are food handling surfaces.

The mineral floor surface includes an untreated outer surface having an initial dynamic coefficient of friction. After treatment of the mineral floor surface according to the subject invention, the initial dynamic coefficient of friction is preferably increased by at least about 10%, more preferably by at least about 15%, and most preferably by at least about 20%. As previously stated, the minimum dynamic coefficient of friction, measured according to ASTM Test No.C1028-89, was established of at least 0.6. The initial dynamic coefficient of friction was found to be less than 0.6 while the dynamic coefficient of friction subsequent to applying the treatment solution to the untreated outer surface of the mineral floor surface was determined to be greater than 0.6. Preferably, when the mineral floor surface is treated according to the teachings of this invention, the dynamic coefficient of friction is increased wherein the outer surface is in either a wet or dry state.

The untreated outer surface has a residual film formed thereon which is infested with bacterial contamination. However, after applying the treatment solution to the untreated outer surface of the mineral floor surface bacterial contamination on the untreated outer surface is substantially eliminated. Preferably bacterial contamination is eliminated for at least about 24 hours, more preferably for at least about 48 hours, and most preferably for at least about 72 hours. In this way, cross-contamination of adjacent areas is prevented. It is noted that floors, being the constant between adjacent locations, are also a medium that allows cross-contamination of germs and dirt from one area to another, particularly within a public buildings. The use of the treatment solution of the present invention helps overcome cross-contamination.

The method of the present invention comprises first forming a treatment solution including ammonium bifluoride, iodine, phosphoric acid, and water. The amount of the ammonium bifluoride is preferably at least about 0.01% by weight, more preferably at least about 0.05% by weight, and most preferably at least about 0.1% by weight, based on the total weight of the treatment solution. In concentrated solutions (for use in reducing shipping costs), the ammonium bifluoride is preferably at least about 5.0% by weight, more preferably at least about 10.0% by weight, and most preferably at least about 15.0% by weight, based on the total weight of the treatment solution.

Iodine and phosphoric acid are provided for disinfecting purposes. The amount of the iodine comprises preferably at least about 0.001% by weight, more preferably at least about 0.005% by weight, and most preferably at least about 0.01% by weight, based on the total weight of the treatment solution. The phosphoric acid preferably at least about 0.01% by weight, more preferably at least about 0.05% by weight, and most preferably at least about 0.1% by weight, based on the total weight of the treatment solution. In concentrated solutions, the amount of the iodine comprises preferably at least about 0.1% by weight, more preferably at least about 0.5% by weight, and most preferably at least about 1.0% by weight, based on the total weight of the treatment solution. The phosphoric acid in concentrated solutions, is preferably at least about 1.0% by weight, more preferably at least about 2.0% by weight, and most preferably at least about 5.0% by, weight, based on the total weight of the treatment solution. The preferred manner of providing the iodine and phosphoric acid is the use of an iodophor. A preferred iodophor product is ZZZ Disinfectant manufactured by WestAgro. The iodine in the ZZZ Disinfectant is in the form of an alpha-(p-Nonylphenyl)-omega-hydroxpoly (oxyethylene)-iodine complex.

The treatment solution is an aqueous solution. The amount of water preferably comprises from about 90% up to about 99.9% by volume, more preferably comprises from about 95% up to about 99.0% by volume, based on the total volume of the treatment solution. In concentrated solutions, the amount of water preferably comprises from about 70% up to about 99.9% by volume, more preferably comprises from about 75% up to about 99.0% by volume, based on the total volume of the treatment solution.

The treatment solution preferably includes a surface active agent. A preferred surface active agent is Pluronic F127 Prill manufactured by BASF Corporation. The amount of the surface active agent is typically 0.01% up to about 6%, preferably from about 0.1% up to about 5.5% by weight, more preferably from about 0.2% up to about 5.5% by weight, and most preferably from about 0.3%,up to about 3.0% by weight, based on the total weight of the treatment solution. The general characteristics used in selecting a surface active agent are that it will not destroy the iodophor, it has a long shelf life (at least one year), and it is a food grade product.

The subject treatment solution is non-corrosive and reasonably non-hazardous in its application form. In effect this invention takes into account the concerns of the EPA, FDA, USDA, OSHA and ADA. The measured pH of the end use product is approximately 4.0–4.5, which is about the same pH as a person's tears.

Another concern addressed by this inventions is the fact that many of the present stronger cleansers for mineral surface floors, and particularly the newer types coming on the market to clean and/or etch the mineral floor surfaces are strong acids and alkalies that are very hazardous and require extensive protective clothing when being used. Because these hazards are not well understood by the applicators, the increased danger to physical health becomes an increasing concern. This invention was specifically formulated to reduce or eliminate these dangers to physical health. The preferred concentration of this invention will not cause harm during intended use if direct contact with the eyes and direct and prolonged contact with the skin is avoided.

In the preferred mode of operation, the use of an "initial treatment" solution will remove almost all of the residual build-up of cleaners/degreasers and any dirt and grease. The continued use of a "maintenance" solution, on a periodic basis, will continue to remove the balance of any residual build-up and to maintain the floor in a clean relatively slip-resistant and germ-free condition.

DETAILED DESCRIPTION OF THE INVENTION

The following formulation was employed in the preparation of the preferred initial treatment solution: 23.3 pounds Ammonium Bi-Fluoride crystals, 82.5 ounces of Disinfectant ZZZ iodophor compound, 6 pounds of the surface active agent Pluronic F127 Prill, and 54.0 gallons water. The initial treatment solution is intended to be used at full strength as received by end user, and is to be scrubbed into all floor surfaces, let stand for 10–30 minutes, and then rinsed and squeegeed or mopped dry.

The maintenance solution, is formulated, as follows: 0.77 ounces of Ammonium Bi-Fluoride crystals, 0.56 ounces of Disinfectant ZZZ iodophor compound, 0.07 ounces of the surface active agent Pluronic F127 Prill, and one gallon of water. The maintenance solution is in its ready-to-use state and is therefore intended to be applied onto the floor surfaces and let air dry. The application frequency of either product depends on several variables such as: daily accumulation of dirts and greases, types of surfaces, location, etc.

In using the invention as described above on a mineral surface floor which is silicon-containing, it is believed that the fluorine replaces the oxygen in the silicon dioxide ($SiO_2$) in the tile and/or concrete, to form a much harder surface on the tile and or concrete. Tile and/or concrete is generally comprised of approximately 30%–40% sand or silicon dioxide. The change from silicon dioxide ($SiO_2$) to silicon fluoride (SiF) produces a slightly roughened and harder surface which enhances the slip-resistance of the tile and/or concrete. At the same time, the iodophor and ammonium bifluoride are acting on the surface of the mineral-floor surface to effectively kill the germs thereon. Some of the iodophor and ammonium remain on the floor even after rinsing to create a residual germ killing effect. This residue substantially eliminates any cross-contamination between adjacent floor surfaces for a period of time.

EXAMPLE 1

A red quarry tile floor in kitchen and scullery (Test Area "A") and a tan tile floor in a dining room area (Test Area "B") were employed for testing the treatment solution of this invention. When wet the untreated tan tile floor presented a condition not unlike walking on ice. This entry area had been cleaned with commercial cleaning agents approximately 2 hours prior to testing. The test area consisted of a 3 foot wide by 4 foot long floor section of tan tile and an immediately adjacent floor area of red quarry tile approximately 3 feet long by 3 feet wide. The subject treatment solution comprised 23.3 pounds Ammonium Bi-Fluoride crystals, 82.5 ounces of Disinfectant ZZZ iodophor compound, 9.7 ounces of Pluronic F127 Prill, and 52.3 gallons of water. This solution was poured on the tan tile test area and lightly brushed around on the surface. Immediately the tan tile area was almost completely slip-resistant to normal walking conditions, as compared to it's initial state described above. The treatment solution was brushed across the red quarry tile and the same slip-resistant conditions occurred immediately.

EXAMPLE 2

Additional testing was done at a second location in two separate areas. The red Quarry tile kitchen was subjected to serving 3 meals a day, 7 days a week. The floor area was cleaned each day with conventional cleaners and/or bleach and/or degreasers. The area was extremely slippery when wet, and when meals were being prepared the water on the floor by the scullery was tracked throughout the area. Coefficient of Friction tests were conducted according to ASTM Test No.C1028-89 modified to utilize a weighted "tennis" shoe, weighted to 6.73 pounds and a 10# spring scale manufactured by Wagner instruments. Sixteen pulls, each pull perpendicular to the previous one, were performed in each of test areas, one test in the area in front of the stove and the other in front of the dishwashing area. Both sets of tests were performed both before and after the treatment solution of the invention was brushed on the test area. The measurements of Test Areas, in both a wet and dry condition, both before and after treatment, were as follows:

| | Dry | Wet |
|---|---|---|
| Test Area "A" (floor by dishwasher): | | |
| Before treatment | .525 | .597 |
| After treatment | .668 | .624 |
| Change from Initial Coefficient of Friction | +.153 | +.027 |
| Change from Initial Coefficient of Friction | 29.1% | 4.5% |
| Test Area "B" (floor by stove): | | |
| Before treatment | .593 | .492 |
| After treatment | .798 | .639 |
| Change from Initial Coefficient of Friction | +.205 | +.147 |
| Change from Initial Coefficient of Friction | 34.6% | 29.9% |
| Average Change from Initial Coefficient of Friction For Test Areas "A" & "B" | 31.9% | 17.2% |

The above data indicates that the use of the treatment solution of this invention increases the Coefficient of Friction above 0.6, and that the average change in Coefficient of Friction, in the wet and dry state, is 31.9% for dry floors and 17.2% for wet floors.

EXAMPLE 3

Tests were performed on the red quarry tile of Test Site "A" as described in Example 1. Sani-check kits manufactured by Biosan Laboratories Inc. (Type AB) were used. Duplicate swab tests were taken in different locations before and after treatment with the treatment solution of the subject invention. The swabs were incubated for 24 hours and then visually checked against reference charts supplied by Sanicheck. The "before" tests showed almost complete colonization of bacteria. On the other hand, the "after" tests showed absolutely none, indicating a 100% kill. Even after 4 days there was absolutely no colonization of the "after" test swabs. Therefore, the application of the subject treatment solution to the germ infested test areas renders approximately 100% kill effect to bacteria upon contact, and maintains this effect residually for more than 72 hours.

Having described and illustrated the principles of the invention in a preferred embodiment thereof, it should be apparent that the invention can be modified in arrangement and detail without departing from such principles. I claim all modifications and variations coming within the spirit and scope of the following claims.

We claim:

1. A method for cleaning, and for treating for slip resistance, an untreated silicon-containing floor surface, which comprises the steps of providing said untreated silicon-containing floor surface including an untreated outer surface having an initial dynamic coefficient of friction, said untreated outer surface having a residual film formed thereon which further includes bacterial contamination;

forming a treatment solution comprising effective treating amounts of ammonium bifluoride, iodine, phosphoric acid, and water;

applying said treatment solution to the untreated silicon-containing outer surface of said silicon-containing floor surface; and forming an outer surface comprising silicon-fluoride thereby (a) substantially reducing the amount of residual film formed on said outer surface, (b) increasing the initial dynamic coefficient of friction of said floor surface by at least about 10%, and (c) substantially eliminating bacterial contamination on said outer surface for at least about 24 hours.

2. The method of claim 1, wherein the outer surface comprises silicon fluoride and silicon iodide.

3. The method of claim 1, wherein the amount of said ammonium bifluoride is at least about 0.01% by weight, based on the total weight of said treatment solution, and the amount of iodine is at least about 0.001% by weight, based on the total weight of said treatment solution.

4. The method of claim 1, wherein the amount of phosphoric acid is at least about 0.01% by weight, based on the total weight of said treatment solution.

5. The method of claim 1, wherein said treatment solution further includes a surface active agent.

6. The method of claim 1, wherein the amount of water comprises from about 70% up to about 99.9% by volume, based on the total volume of said treatment solution.

7. The method of claim 1, wherein the dynamic coefficient of friction is increased wherein the outer surface is in either a wet or dry state.

8. The method of claim 1, wherein the initial dynamic coefficient of friction is increased by at least about 20%.

9. The method of claim 1, wherein said bacterial contamination on said untreated outer surface is substantially eliminated for at least about 48 hours.

10. The method of claim 1, wherein said treatment solution reacts with said residual film to form a biodegradable, odorless, germicidal soap that cleans the untreated outer surface.

11. A method of using a treatment solution for cleaning, and for treating for slip resistance, an untreated silicon-containing floor surface, which comprises the steps of providing said untreated silicon-containing floor surface including an untreated outer surface having an initial dynamic coefficient of friction, said untreated outer surface having a residual film formed thereon which further includes bacterial contamination;

forming a treatment solution comprising effective treating amounts of ammonium bifluoride, iodine, phosphoric acid, and water; and applying said treatment solution to the untreated silicon-containing outer surface of said silicon-containing floor surface; and forming a silicon-fluoride outer surface thereby (a) substantially reducing the amount of residual film formed thereon (b) increasing the initial dynamic coefficient of friction by at least about 10%, and (c) substantially eliminating bacterial contamination on said untreated outer surfaces for at least about 24 hours.

12. The method of claim 11, wherein the amount of said ammonium bifluoride is at least about 0.01% by weight, based on the total weight of said treatment solution.

13. The method of claim 11, wherein the amount of iodine is at least about 0.001% by weight, based on the total weight of said treatment solution.

14. The method of claim 11, wherein the amount of phosphoric acid is at least about 0.01% by weight, based on the total weight of said treatment solution.

15. The method of claim 11, wherein said treatment solution further includes a surface active agent.

16. The method of claim 11, wherein the amount of water comprises from about 90% up to about 99.9% by volume, based on the total volume of said treatment solution.

17. The method of claim 11, wherein the dynamic coefficient of friction is increased wherein the outer surface is in either a wet or dry state.

18. The method of claim 11, wherein the initial dynamic coefficient of friction is increased by at least about 20%.

19. The method of claim 11, wherein said bacterial contamination on said untreated outer surface is substantially eliminated for at least about 48 hours.

20. The method of claim 11, wherein said treatment solution reacts with said residual film to form a biodegradable, odorless, germicidal soap that cleans the untreated outer surface.

* * * * *